US006980125B1

(12) United States Patent
Barber

(10) Patent No.: US 6,980,125 B1
(45) Date of Patent: Dec. 27, 2005

(54) WARNING LIGHT SYSTEM FOR ALERTING PEDESTRIANS AND PASSENGER VEHICLE OPERATORS OF AN APPROACHING EMERGENCY VEHICLE

(76) Inventor: John Barber, 14701 Fleming Ave., Bellflower, CA (US) 90706

( * ) Notice: Subject to any disclaimer, the term of this patent is extended or adjusted under 35 U.S.C. 154(b) by 106 days.

(21) Appl. No.: 10/822,011

(22) Filed: Apr. 9, 2004

Related U.S. Application Data

(60) Provisional application No. 60/461,517, filed on Apr. 9, 2003.

(51) Int. Cl.[7] ..... G08G 1/07

(52) U.S. Cl. ..... 340/917; 340/906; 340/907; 340/331; 340/332; 340/902; 340/905; 116/63 R

(58) Field of Search ..... 340/917, 906, 340/907, 331, 332, 902, 905; 116/63 R

(56) References Cited

U.S. PATENT DOCUMENTS

| | | | | |
|---|---|---|---|---|
| 4,806,931 A | | 2/1989 | Nelson | 340/907 |
| 5,287,411 A | | 2/1994 | Hill | 381/36 |
| 5,345,232 A | * | 9/1994 | Robertson | 340/906 |
| 5,448,219 A | * | 9/1995 | Yoshikawa et al. | 340/436 |
| 5,495,242 A | * | 2/1996 | Kick et al. | 340/902 |
| 5,710,555 A | * | 1/1998 | McConnell et al. | 340/916 |
| 5,801,646 A | | 9/1998 | Pena | 340/902 |
| 5,889,475 A | | 3/1999 | Klosinski | 340/902 |
| 6,064,319 A | * | 5/2000 | Matta | 340/917 |
| 6,072,406 A | * | 6/2000 | Leonard et al. | 340/902 |
| 6,522,263 B2 | * | 2/2003 | Jones | 340/915 |

* cited by examiner

*Primary Examiner*—Daryl C Pope
(74) *Attorney, Agent, or Firm*—Goldstein Law Office PC

(57) ABSTRACT

A warning light system for a traffic intersection for alerting pedestrians and operators of passenger vehicles to the approach of an emergency vehicle. The warning light system is activated only by sounds in the range of frequencies which are emitted by the siren of an emergency vehicle. The warning light system has a warning light assembly having a control unit, and also has an audio sensor unit. The warning light assembly has a blue light and a white light, which flash alternately and repeatedly, after receipt of an audio signal by the audio sensor unit from the siren of an emergency vehicle, and processing of that signal by the control unit. The lights of the warning light assembly continuously flash until the sound emitted from the siren is no longer detectable by the audio sensor.

4 Claims, 4 Drawing Sheets

WARNING LIGHT SYSTEM FOR ALERTING PEDESTRIANS AND PASSENGER VEHICLE OPERATORS OF AN APPROACHING EMERGENCY VEHICLE

CROSS REFERENCES AND RELATED SUBJECT MATTER

This application is a continuation of provisional patent application Ser. No. 60/461,517, filed in the United States Patent Office on Apr. 9, 2003.

BACKGROUND OF THE INVENTION

1. Field of the Invention

The invention relates to a warning light system for a traffic intersection for alerting pedestrians and operators of passenger vehicles of the approach of an emergency vehicle.

2. Description of the Related Art

It is well known that emergency vehicles have the right of way over passenger vehicles. In this regard, when an emergency vehicle is in the area, it is incumbent upon all passenger vehicles and pedestrians to get out of the way while the emergency vehicle passes. It is not always possible, however, to hear an emergency vehicle. Particular difficulty is often encountered at intersections, where a passenger vehicle and emergency vehicle may be approaching at a high speed. Due to obstructions between their respective roadways, the siren might not be audible to the driver of a passenger vehicle traveling on a perpendicular road, until there is insufficient time to stop.

Various warning systems have been devised for alerting pedestrians and passenger vehicle operators of approaching emergency vehicles. For example, U.S. Pat. No. 5,801,646 to Pena appears to show a warning system for a traffic intersection having a strobe light. However, Pena contemplates a two-stage warning system, wherein the first stage is characterized by activation of an upper strobe light and wherein the second stage is characterized by activation of side-mounted strobe lights. Accordingly, Pena fails to provide a single-stage, unambiguous warning system for alerting pedestrians and drivers of an approaching emergency vehicle.

Additionally, U.S. Pat. No. 5,889,475 to Klosinski appears to show a warning system for pedestrians and drivers which provides a visual and an audio alert to pedestrians and drivers of passenger vehicles. Accordingly, Klosinski fails to provide a simple, unambiguous warning system which visually alerts pedestrians and drivers of the approach of an emergency vehicle.

Furthermore, U.S. Pat. No. 4,806,931 to Nelson and U.S. Pat. No. 5,287,411 to Hill both appear to show a warning system which detects the siren of an emergency vehicle. However, both Nelson and Hill appear to describe systems for controlling existing traffic lights at an intersection. Accordingly, both Nelson and Hill fail to provide an auxiliary warning system which operates separately from the existing traffic lights at an intersection, for alerting pedestrians and passenger vehicles of the approach of the emergency vehicle.

While these systems may be suitable for the particular purpose employed, or for general use, they would not be as suitable for the purposes of the present invention as disclosed hereafter.

SUMMARY OF THE INVENTION

It is an object of the invention to provide a warning light system which alerts pedestrians and operators of passenger vehicles traveling towards an intersection to the approach of an emergency vehicle. Accordingly, the warning light system has white and blue lights, which flash repeatedly upon activation by a siren of an emergency vehicle, thereby alerting pedestrians and operators of vehicles to the approach of an emergency vehicle.

It is another object of the invention to provide a warning system for a traffic intersection which alerts even individuals with impaired hearing that an emergency vehicle is approaching the intersection. Accordingly, the flashing lights of the warning light system alerts even individuals who have trouble hearing a distant siren to the approach of an emergency vehicle.

It is yet another object of the invention to provide a warning light system which provides pedestrians and operators of passenger vehicles with sufficient notice of an approaching emergency vehicle, so that they may move out of the way of the emergency vehicle. Accordingly, the warning light system is activated by a siren on an emergency vehicle even when the emergency vehicle is at distances of up to one hundred yards from the audio sensor of the warning light system. This provides pedestrians and passenger vehicle operators with sufficient notice of an approaching emergency vehicle, so that they may move out of the way of the emergency vehicle, well before the emergency vehicle reaches the traffic intersection.

The invention is a warning light system for a traffic intersection for alerting pedestrians and operators of passenger vehicles to the approach of an emergency vehicle. The warning light system is activated only by sounds in the range of frequencies which are emitted by the siren of an emergency vehicle. The warning light system has a warning light assembly having a control unit, and also has an audio sensor unit. The warning light assembly has a blue light and a white light, which flash alternately and repeatedly, after receipt of an audio signal by the audio sensor unit from the siren of an emergency vehicle, and processing of that signal by the control unit. The lights of the warning light assembly continuously flash until the sound emitted from the siren is no longer detectable by the audio sensor.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
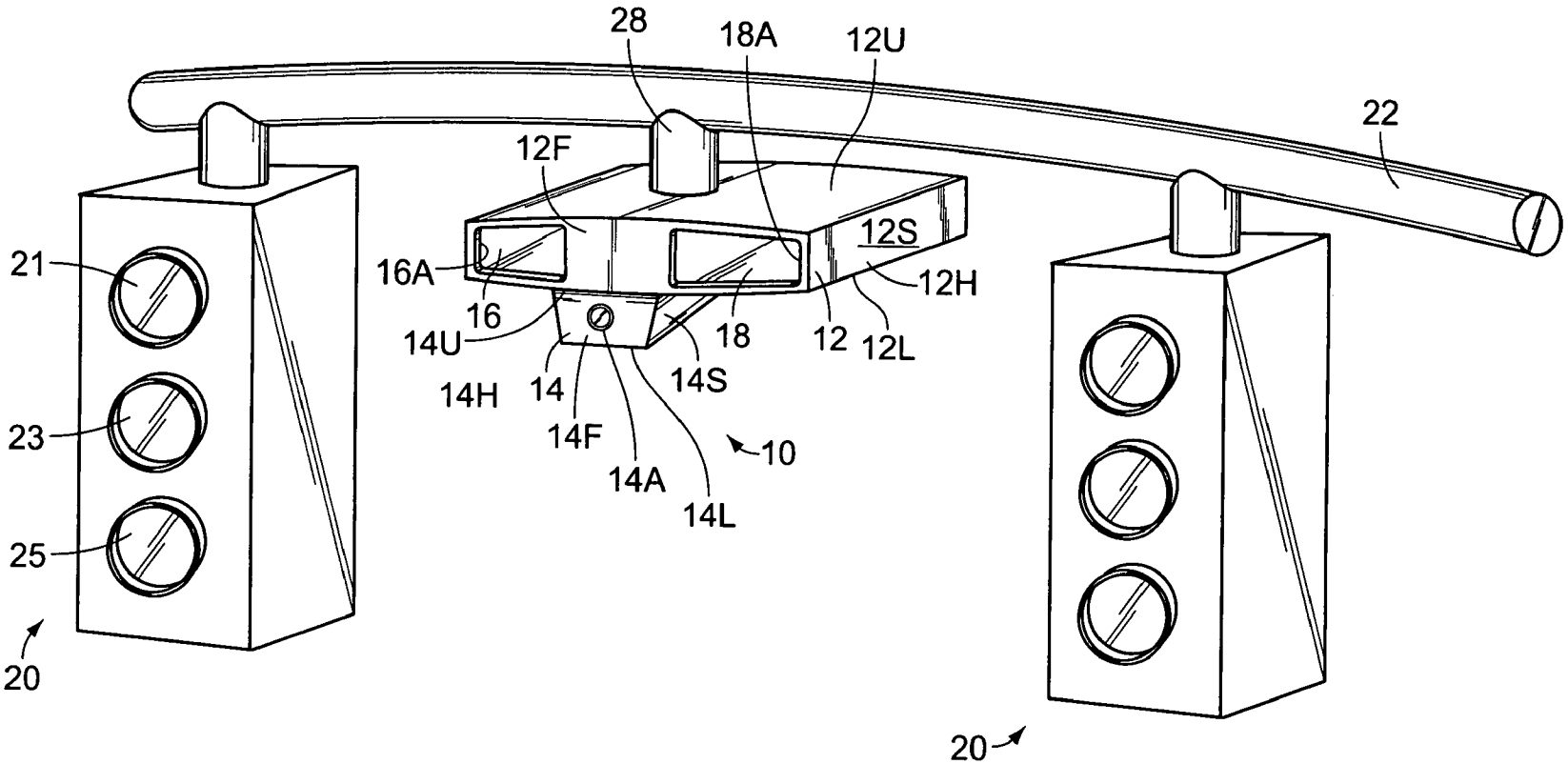
FIG. 1 is a perspective view of the warning light system, attached to an existing traffic light pole.

FIG. 1 illustrates a perspective view of the warning light system 10, attached to an existing traffic light pole 22. The traffic light pole 22 also has two existing traffic light assemblies 20 attached thereunto, each having a red light 25, a green light 21, and a yellow light 23, for indicating to pedestrians and passenger vehicles whether to stop, proceed, or proceed with caution into an intersection. The warning light system 10 comprises a warning light assembly 12 which is enclosed by a warning light housing 12H, and an audio sensor unit 14 enclosed within an audio sensor unit housing 14H. The warning light housing 12H has an upper surface 12U, a lower surface 12L, two opposing side surfaces 12S, a front surface 12F, and a rear surface. Similarly, the audio sensor unit housing 14H has an upper surface 14U, a lower surface 14L, two opposing side surfaces 14S, a front surface 14F, and a rear surface. The upper surface 14U of the audio sensor unit housing 14H is attached to the lower surface 12L of the warning light housing 12H. The warning light housing 12H contains a white light 16 and a blue light 18 and has two substantially rectangular openings 16A and 18A which extend fully through the front surface 12F of the warning light housing 12H, which allow for unimpeded viewing of the white light 16 and the blue light 18. Each of the rectangular openings 16A and 18A are preferably covered by a sturdy, transparent, glass or plastic lens, for protection of the lights 16, 18. The audio sensor unit housing 14H encloses an audio sensor which detects ambient sound. The warning light housing 12H additionally contains a control unit which isolates frequencies and sound patterns associated with the siren of an emergency vehicle, and outputs the isolated signal, thereby causing the white light 16 and the blue light 18 to flash alternately and repeatedly, as will be described hereinafter.

The audio sensor unit housing 14H has an aperture 14A which extends fully through its front surface 14F, thereby enabling sound waves from an approaching emergency vehicle to reach the audio sensor contained within the audio sensor unit housing 14H. The upper surface 12U of the warning light housing 12H has an anchor 28 extending therefrom, for selective attachment of the warning light system 10 to an existing traffic light pole 22. Obviously, a variety of methods are available for attachment of the warning light system 10 to the traffic light pole 22. For example, the warning light system 10 may be bolted or clamped onto the existing traffic light pole.

Figure 2:
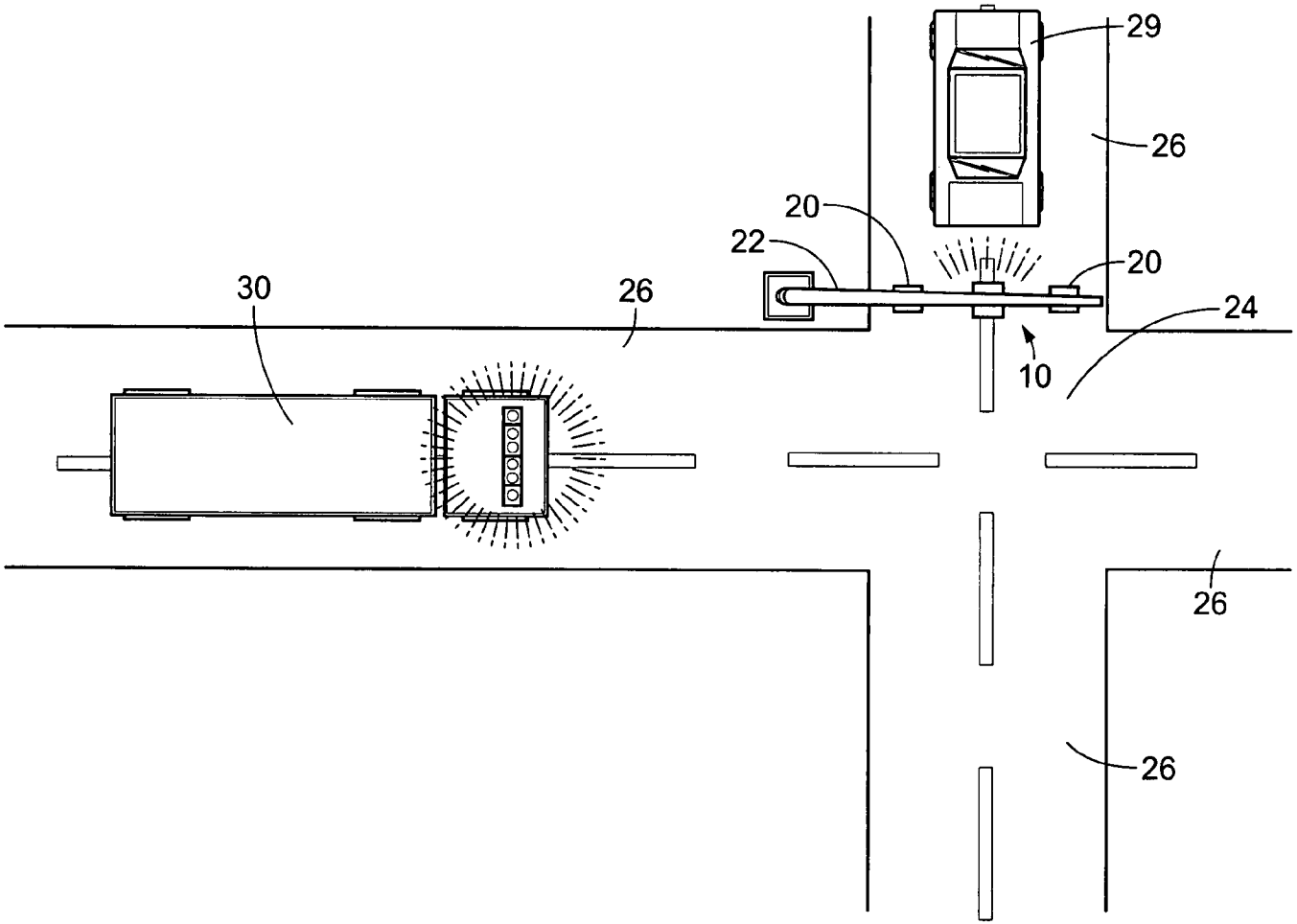
FIG. 2 is a top plan view diagrammatically illustrating the warning light system being activated by the siren of an emergency vehicle approaching an intersection, thereby alerting a driver of a passenger vehicle approaching the same intersection of the approach of the emergency vehicle.

FIG. 2 illustrates a top plan view, diagrammatically illustrating the warning light system 10 being activated by the siren on the approaching emergency vehicle 30. The warning light system 10 is attached to an existing traffic light pole 22 at a four-way intersection 24 where two roads 26 intersect at a right angle. A passenger vehicle 29 is traveling on one of the roads 26 and is headed toward the four-way intersection 24. Similarly, the emergency vehicle 30 is also heading toward the same four-way intersection 24, on the other road 26. The traffic light pole 22 is positioned between the vehicle 29 and the four-way intersection 24. The emergency vehicle 30 has a siren which is emitting sound waves of a particular frequency. The sound waves are detected by the audio sensor contained within the warning light system 10. Upon detection of the sound waves from the siren by the audio sensor, the control unit within the warning light assembly causes the white light 16 and the blue light 18 to alternately and repeatedly flash, thereby providing the driver of the passenger vehicle 29 with an unambiguous warning of the approach of the emergency vehicle 30 to the intersection 24.

Figure 3:
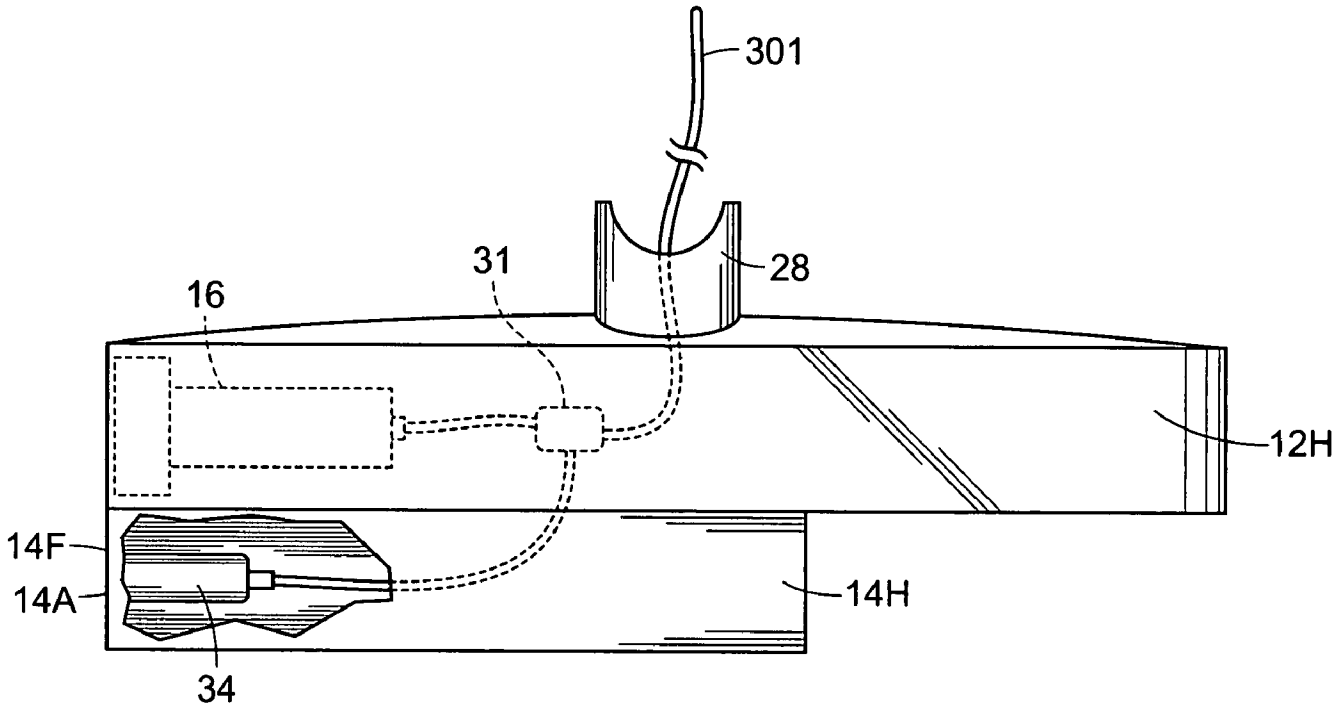
FIG. 3 is a side elevational view of the warning light system, with parts of the housing broken away to illustrate electrical components contained therein.

FIG. 3 illustrates a side elevational view of the warning light system 10, with parts broken away to show internal details of the audio sensor unit housing 14H, also showing internal details of the warning light housing 12H in hidden lines. In particular, the audio sensor unit housing 14H contains the audio sensor 34, which detects ambient audio signals which enter the audio sensor unit 14 through the aperture 14A which extends fully through the front surface 14F of the audio sensor unit housing 14H. An electrical cord 301 extends from the traffic light pole 22 through the anchor 28, for connection to a power supply for powering the warning light system 10. The control unit 31, which processes the audio input which is detected by the audio sensor 34 and which causes the lights 16, 18 to alternately flash, is located within the warning light housing 12H. The control unit 31 may alternately be positioned within the audio sensor unit housing 14H. For simplicity, only the white light 16 is illustrated.

Figure 4:
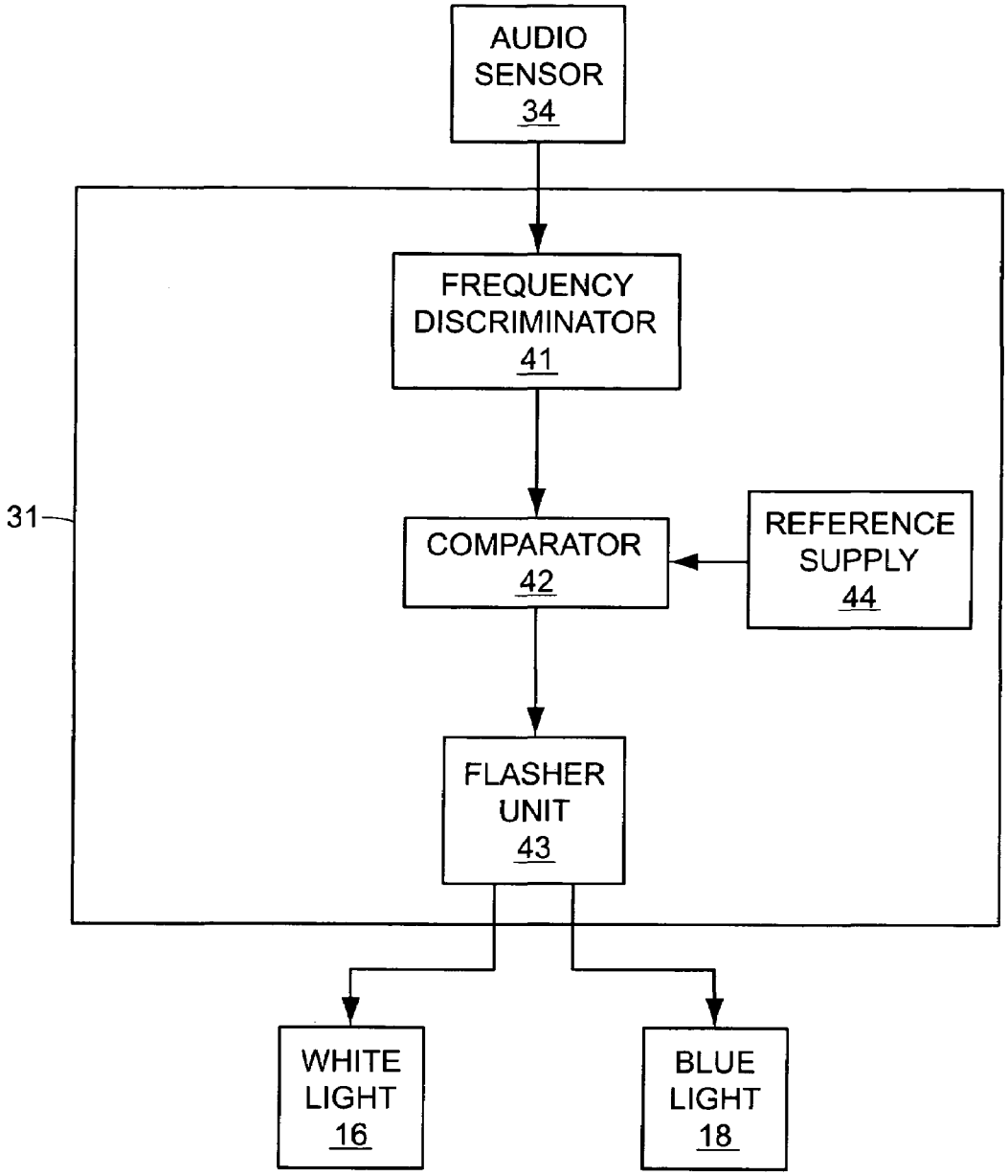
FIG. 4 is a block diagram illustrating the functional interconnection of various components of the invention.

FIG. 4 is a block diagram illustrating the interconnection of various electrical components of the invention. The electrical components comprise the control unit 31, the audio sensor 34, the white light 16, and the blue light 18. The control unit 31 has a frequency discriminator 41, a comparator 42, a reference supply 44, and a flasher unit 43. The audio sensor 34 detects ambient sound and provides an output to the frequency discriminator 41, which isolates frequencies and sound patterns associated with emergency vehicle sirens, and outputs an isolated signal. The comparator 42 compares the isolated signal to the reference supply 44 and produces an output when the isolated signal is above a threshold value set by the reference supply 44. In response to the output from the comparator 42, the flasher unit 43 is activated to alternately flash the white light 16 and the blue light 18. When the emergency vehicle is sufficiently distant from the audio sensor 34, the isolated signal will be weak, thus deactivating the flasher unit 43 to shut off the flashing lights 16, 18.

In use, the warning light system 10 is selectively attached to an existing traffic light pole 22 at a traffic intersection, with the openings 16A, 18A in the front surface 12F of the warning light housing 12H oriented so as to face passenger vehicles and pedestrians approaching the traffic intersection. Upon selective activation of the warning light system 10 by audio signals produced by a siren of an emergency vehicle 30, the lights 16 and 18 alternately and repeatedly flash, thereby providing the driver of the passenger vehicle with an unambiguous alert of the approach of the emergency vehicle 30. When the sound waves from the siren diminishes to a point where they are no longer detectable by the audio sensor 34, the lights 16 and 18, under the control of the control unit 31, cease to flash.

In conclusion, herein is presented a warning light system for alerting pedestrians and operators of passenger vehicles of the approach of an emergency vehicle. The invention is illustrated by example in the drawing figures, and throughout the written description. It should be understood that numerous variations are possible, while adhering to the same basic concept. Such variations are contemplated as being a part of the present invention.

What is claimed is:

1. A warning light for alerting pedestrians and passenger vehicle operators of an approaching emergency vehicle, for mounting on a traffic light pole, comprising:

a warning light housing having a front surface and two substantially rectangular openings which extend fully through the front surface of the warning light housing, a white light and blue light within the housing, the white light visible through one of the rectangular openings and the blue light visible through the other of the rectangular openings;

an audio sensor unit, for detecting ambient sound at the warning light housing;

a frequency discriminator, for analyzing the ambient sound detected by the audio sensor unit, and providing an isolated signal of frequencies associated with emergency vehicle sirens; and a control unit for alternatively flashing the white and blue lights when the isolated signal indicates the significant presence of frequencies associated with emergency vehicle sirens, for warning pedestrians and passenger vehicle operators of the approach of emergency vehicles.

2. The warning light as recited in claim 1, wherein the upper surface of the warning light housing has an anchor extending therefrom for attachment to the traffic light pole.

3. The warning light as recited in claim 2, further comprising a comparator and a reference supply, the compoarator comparing the isolated signal to the reference supply for producing an output used by the control unit to initiate the flashing of the white and blue lights when the isolated signal exceeds a threshold value set by the reference supply.

4. The warning light as recited in claim 3, further comprising an audio sensor housing having a front surface aligned with the front surface of the warning light housing, and an upper surface that is attached to the lower surface of the warning light housing, wherein the front surface of the audio sensor housing has an aperture, and wherein ambient sounds enter the sound sensor through said aperture.

* * * * *